US005343716A

United States Patent [19]

Swanson et al.

[11] Patent Number: 5,343,716

[45] Date of Patent: Sep. 6, 1994

[54] BEVERAGE DISPENSER WITH IMPROVED COLD PLATE

[75] Inventors: Craig Swanson; Henry E. Ramon, III; Ty C. Taylor, all of San Antonio, Tex.

[73] Assignee: IMI Cornelius Inc., Anoka, Minn.

[21] Appl. No.: 85,217

[22] Filed: Jun. 29, 1993

[51] Int. Cl.[5] ..... B67D 5/62

[52] U.S. Cl. ..... 62/389; 222/146.6; 62/390; 62/396

[58] Field of Search ..... 62/389, 390, 398, 399, 62/396; 222/146.6

[56] References Cited

U.S. PATENT DOCUMENTS 5,080,261 1/1992 Green ..... 222/146.6

5,249,710 10/1993 Hassel ..... 222/146.6

*Primary Examiner*—John M. Sollecito

*Attorney, Agent, or Firm*—Sten Erik Hakanson

[57] ABSTRACT

A beverage dispenser of the cold plate type as shown wherein the cold plate is oriented within a housing of a dispenser such that the fluid lines extending through the cold plate extend in a pattern for preventing ice bridging occurring at the back end of the device. The cold plate also includes stainless steel wire coils within each water line along an end portion thereof for turbulating the water as it passes there through to provide for enhanced heat exchange between the fluid and the cold plate and the fluid line end portion.

14 Claims, 5 Drawing Sheets 10
26
26
25
24
C
22
18
16
27
39a
12
28
14
32
20
39b
34
30
36
36

26
26
25
24
C
O
32
32
32
32
39a
37b
32
56
37a
39b
30
36

40
40
30
37b
38
35
4
4
34
39b
39a
34
35
37a
34a
34b 30
28
34a
34b
34b
42
42
42

BEVERAGE DISPENSER WITH IMPROVED COLD PLATE

BACKGROUND OF THE INVENTION

1. Field of the Invention

The present invention relates generally to beverage dispensers having cold plates for providing cooling of the beverage constituents, and to such beverage dispensers having cold plates with improved heat exchange ability.

2. Background

Beverage dispensers including cold plates having serpentine tubes extending there through for providing cooling of beverage constituents, are well known in the art. Such dispensers include a cold plate forming the bottom of an ice retaining bin for providing heat exchange cooling of the beverage constituents as they flow through the internal tubes. After passing through the cold plate, the tubes are connected to a beverage dispensing array, such as a beverage tower having a plurality of post mix beverage dispensing valves secured thereto. Such dispensers are typically of the "drop-in" type, wherein the cold plate and ice retaining bin are retained below the level of a counter top surface. The tower extends above and along a back edge of the bin, and a door is provided for access to the ice in front of the tower. Cups can then be filled with ice and subsequently filled with beverage by an operator standing behind the counter opposite from the tower.

A problem with such prior art dispensers concerns the problem of "ice bridge" formation. As is known, heat exchange melting of the ice at the top surface of the cold plate can result in the formation of air pockets between the remaining ice and the top surface of the cold plate. When this occurs, the insulating effect of the air pocket greatly reduces heat exchange between the ice and the beverage constituents flowing through the cold plate.

Heretofore, the operator has had to periodically attempt to break these ice bridges and eliminate the air insulation layer. Unfortunately, these ice bridges can occur at the back of the bin in the area thereof underneath the tower where it is difficult, particularly when the bin is substantially full of ice, for the operator to reach and eliminate the problem. Accordingly, it would be very desirable to have a cold plate cooled dispenser wherein any ice bridging only occurs in an area easily accessed by the operator.

With respect to cold plates specifically, it is always desirable to obtain the maximum amount of heat transfer between the ice and the beverage constituents. A problem with present cold plates concerns the fact that a majority of the heat exchange occurs along the first several feet of the serpentine tubes found therein, and very little occurs in the last few feet of each tube. Thus, it would be desirable to increase heat transfer throughout the end few feet of the heat exchange tubes.

SUMMARY OF THE INVENTION

The beverage dispenser of the present invention includes a lower housing for retaining the cold plate. The cold plate has four metal sides extending around a perimeter thereof and extending upward therefrom for defining an ice retaining bin. The housing has a top front lid for providing access to the ice retaining bin, and includes a beverage dispensing tower secured thereto along a back edge thereof, having a plurality of beverage dispensing valves suspended therefrom. The cold plate includes a plurality of serpentine tubes extending therethrough from inlet ends to outlet ends thereof. The inlet ends are secured to reservoirs of syrup and carbonated water and the outlet ends are fluidly connected to the beverage dispensing valves.

In prior art cold plate based dispensers, the serpentine coils extend through the cold plate typically from the right side to the left side thereof. Thus, the coils alternate back and forth between the front and the rear of the cold plate as they progress from the left side to the right side. Therefore, the initial high heat exchange portion of each coil is contained in substantially the left half of the cold plate. As a result thereof, some of the initial high heat exchange portion of each tube exists directly below the beverage dispensing tower. In the beverage dispenser of the present invention, the cold plate is designed and oriented in the ice retaining bin so that the coils extend from the front of the cold plate to the rear. Thus, from the perspective of an operator, the coils alternate between right and left sides of the cold plate as they extend from the front to the rear thereof. It can be appreciated that the entire high heat transfer portion will then be located in the front half of the cold plate and thereby positioned directly below the access lid. Thus, any ice bridging that occurs will occur over a surface area of the cold plate that can be more easily accessed by the operator and eliminated.

The cold plate of the present invention also includes a turbulating means, consisting in one embodiment of a stainless steel wire coil extending through the last few feet of each serpentine tube. Thus, as the fluid flows through each individual tube the coiled wire provides for turbulating the fluid flow thereof. This disruption of the fluid flow provides for increased opportunity for heat exchange between the fluid and the cold plate.

DESCRIPTION OF THE DRAWINGS

Further understanding of the structure and operation, and objects, features and advantages of the present invention can be had in light of the following detailed description, which description refers to the following drawings wherein.

DETAILED DESCRIPTION OF THE PREFERRED EMBODIMENT

Figure 1:
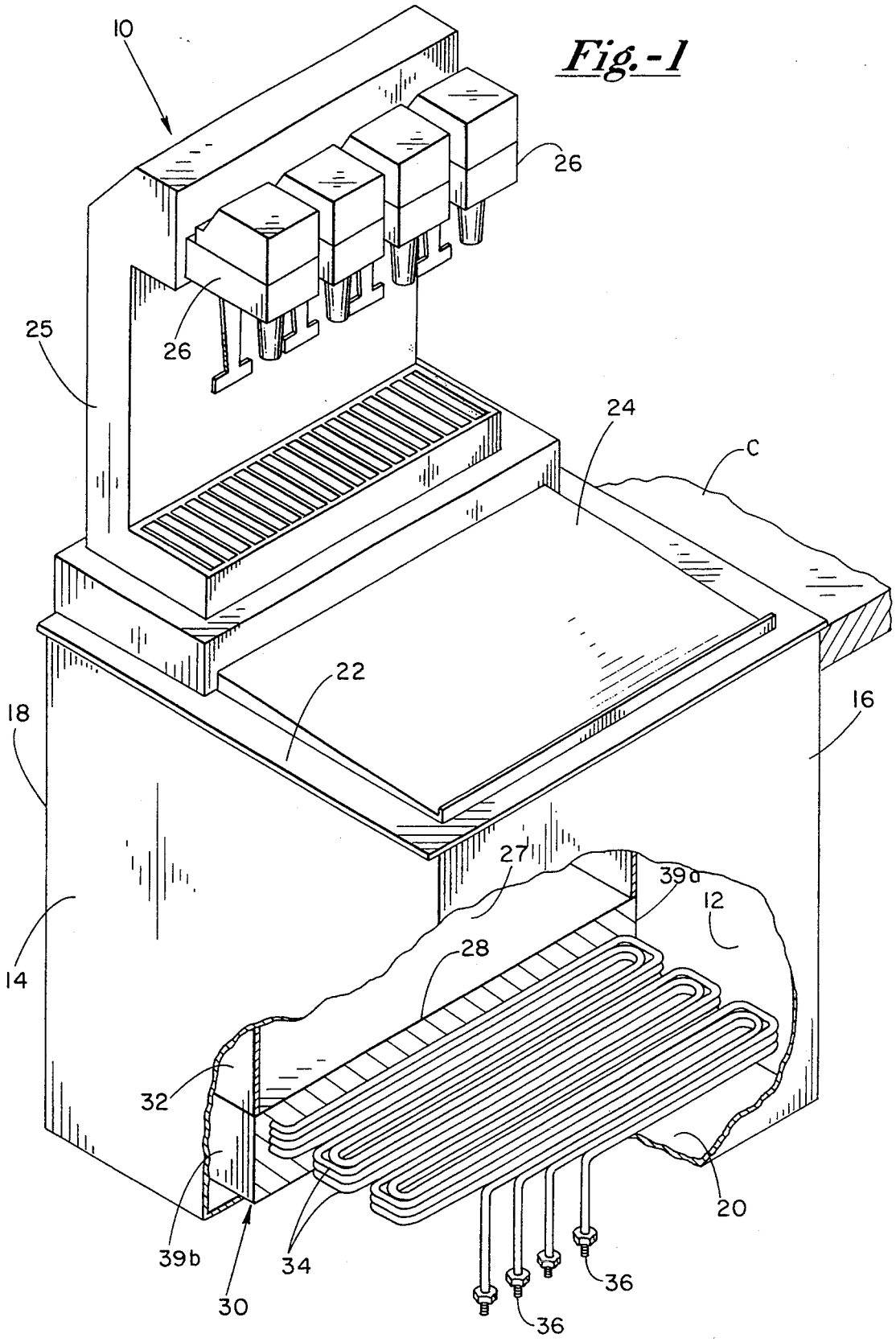
FIG. 1 shows a partial cut away perspective view of the beverage dispenser and cold plate of the present invention.
Figure 2:
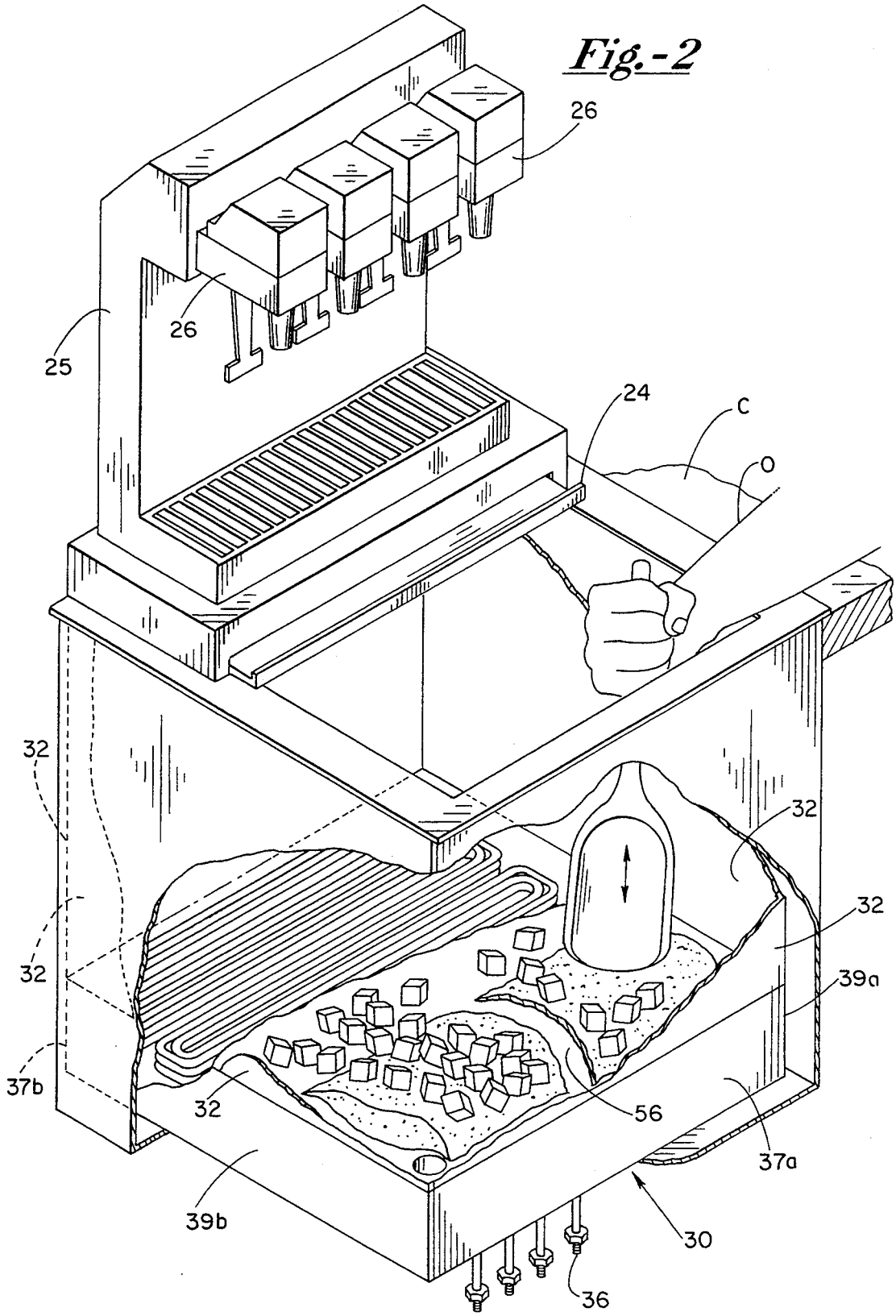
FIG. 2 shows a further partial cut away perspective view of the present invention showing ice bridging.

The beverage dispenser of the present invention is seen in FIGS. 1 and 2 and generally indicated by the numeral 10. Dispenser 10 includes an external housing having right and left sides 12 and 14, front and rear sides 16 and 18 and a bottom end 20. The top surface of housing 11 is comprised of a tower supporting shelf portion 22 and an access lid 24. A tower 25 is secured to shelf 22, and has a plurality of beverage dispensing valves 26 suspended therefrom. Access lid 24 is slideably engageable with support portion 22 and provides for access into an ice retaining bin area 27. Ice retaining bin area 27 is defined by a top surface 28 of a cold plate 30 and ice bin liner walls 32 secured around the perimeter of plate 30.

Figure 3:
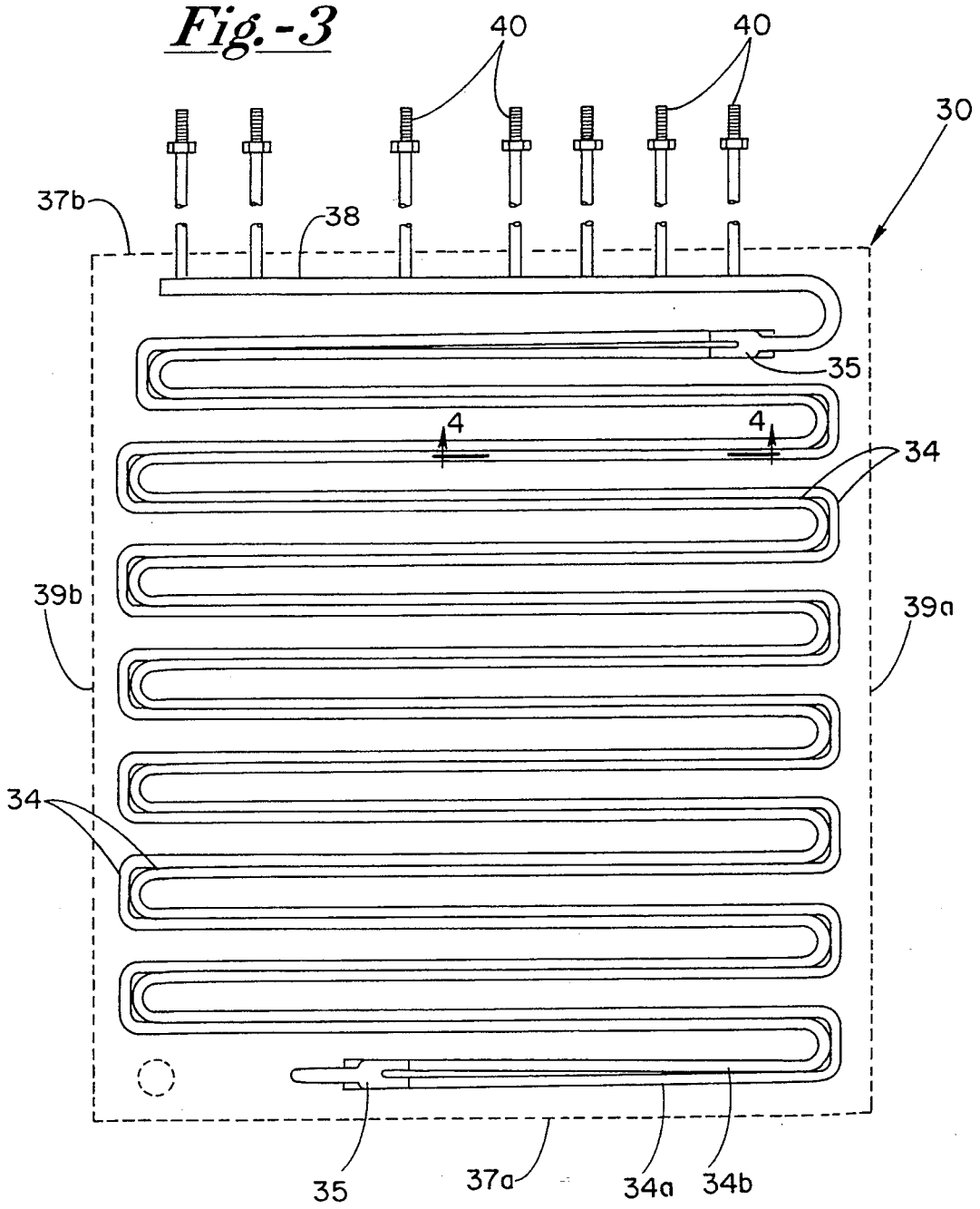
FIG. 3 shows a top plan view of the pattern of the fluid coils of the cold plate of the present invention.

As seen by also referring to FIG. 3, plate 30 typically consists of aluminum cast around a plurality of layers of individual fluid lines or tubes 34 extending there through in a serpentine fashion. Each line 34 has an inlet 36 adjacent the housing front surface 16. Fluid lines 34 typically carry syrup or carbonated water and extend through cold plate 30 from a front 37*a* to a rear 37*b* thereof in a manner alternating back and forth in a direction between right and left sides 39*a* and 39*b* thereof. In the case of the lines 34 carrying carbonated water, such lines are generally parallel being divided by dividers 35 into lines 34*a* and 34*b* for providing a larger heat exchange surface. Such lines 34*a* and 34*b* can terminate in a common manifold 38 having a plurality of carbonated water lines 40 extending therefrom for connection to each beverage dispensing valve 26.

Figure 4:
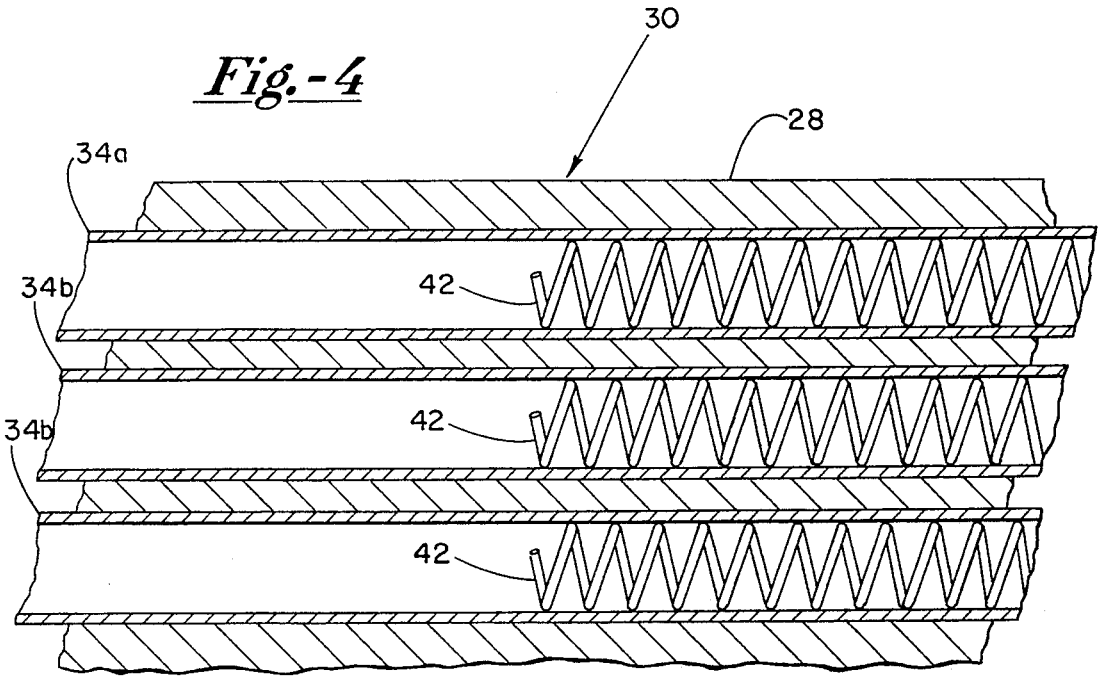
FIG. 4 shows an enlarged cross-sectional view of the fluid coils along lines 4—4 of FIG. 2.

As seen in FIG. 4, a turbulating means such as a stainless steel wire coil or spring 42 extends through an end portion of each carbonated water line 34*a* and 34*b*. In a typical embodiment wherein each line 34*a* and 34*b* is approximately 24 feet long, coils 42 extend along the end 2 feet thereof up to the divider 35 adjacent manifold 38. The manufacture thereof is obtained by inserting each coil 42 within each line 34*a* and 34*b* prior to the serpentine bending thereof. It can be appreciated, that after such bending coils 42 are firmly held there within. In the above embodiment lines 34*a* and 34*b* have an outside diameter (O.D.) of 0.312 inch, a wall thickness of 0.020 inch, and hence an inside diameter (I.D.) of 0.272 inch. Also coils 42 are 60 gauge wire.

Figure 5:
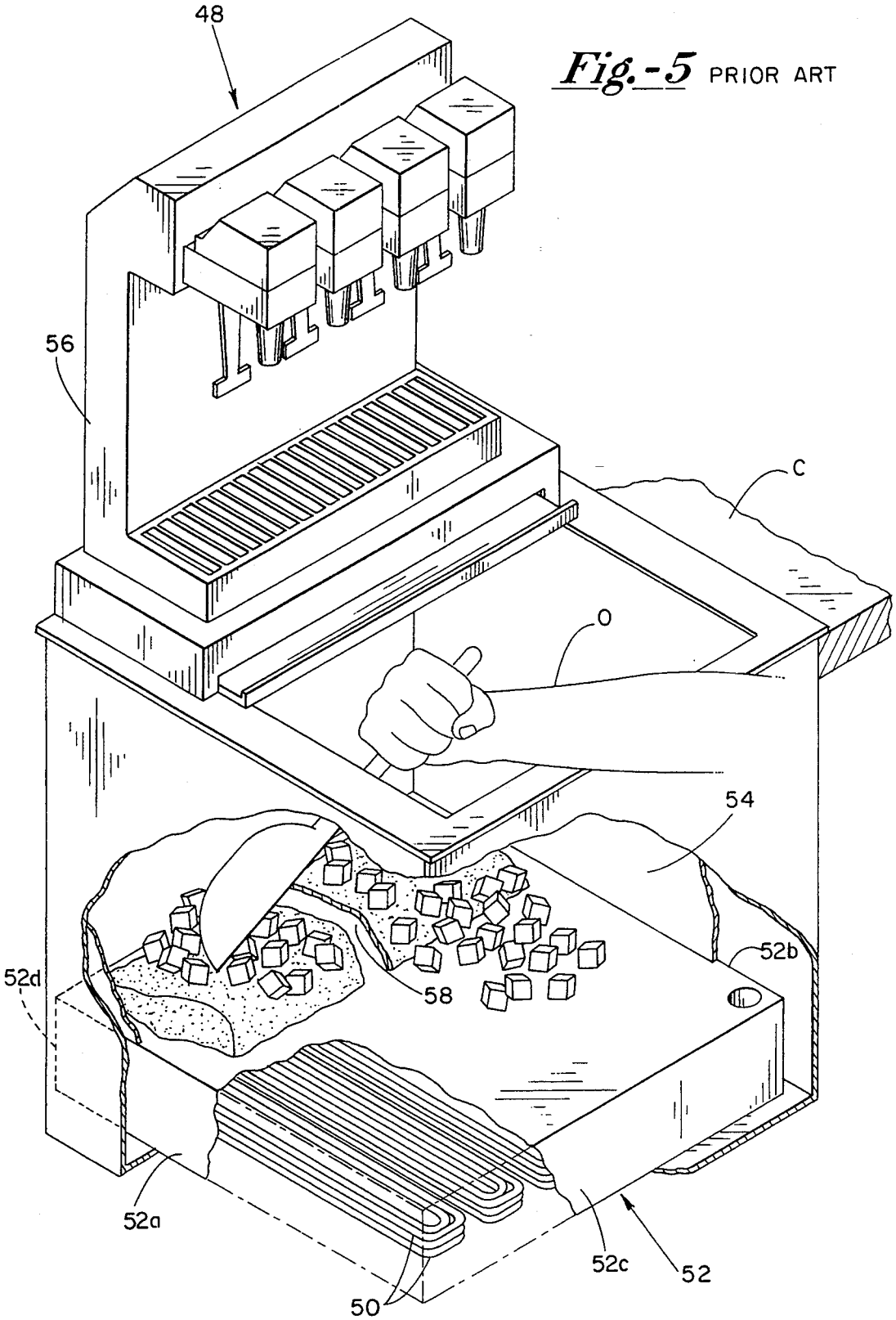
Fig.-5 PRIOR ART
FIG. 5 shows a partial cut away perspective view of a typical prior art cold plate type beverage dispenser.

A full appreciation of the operation of the present invention can be had by first reviewing a typical prior art cold plate type beverage dispenser 48, as seen in FIG. 5. Beverage dispenser 48 includes cold plate 50 having beverage lines 52 extending therethrough. Specifically, lines 50 extend from a left side 52*a* to a right side 52*b* of cold plate 52 in a manner alternating back and forth between a front and rear ends 52*c* and 52*d* respectively thereof. Dispenser 48 includes an ice retaining bin 54 and a dispensing tower 56.

It can be understood that the initial high heat exchange portion of lines 52 will extend in part beneath tower 56 at the rear of dispenser 48. As a result thereof, any ice bridging 58 that occurs in that area underneath tower 56 can be physically difficult to reach from the perspective of an operator O standing behind a counter top C wherein the ice retaining bin 54 is located between the operator and the dispensing tower 56. Breaking up bridge 58 is further complicated by the fact that sanitary conditions should always be maintained wherein the operator must minimize any physical contact with the ice. By contrast, in the present invention, since most of the heat exchange, and therefore the potential for bridging, occurs during the first several feet of each beverage line 34, any bridging 60 that will occur in the present invention will exist directly below access door 24. In other words, such bridging will occur over substantially the front half of plate 30 as coils 34 extend from front 37*a* to rear 37*b* of plate 30. Therefore, elimination of such ice bridging is greatly simplified because the operator O can access such bridging much more easily and eliminate it, and do so in a manner that more easily maintains sanitary conditions.

It can also be appreciated that the wire coils 42 provide for turbulating of the fluid, typically syrup or carbonated water, flowing through lines 34*a* and 34*b*. This turbulation of fluid flow increases the surface area of contact between the fluid and the respective lines 34*a* and 34*b*. Thus, cold plate 30 can obtain improved heat exchange results. It will be appreciated by those of skills that various other turbulating means can provide for the passive imparting of motion to the fluid flowing through each lines 34*a* and 34*b*. For example, lines 34*a* and 34*b* could include indents in the surfaces thereof which intrude into the interior thereof for imparting such fluid motion. Of course, other variously shaped wires or structures could be placed in lines 34*a* and 34*b* to provide for such flow turbulation. It will be appreciated by those of skill that any obstruction such as coils 42 will result in a pressure drop along lines 34*a* and 34*b*. In the above described embodiment coils 42 provide for turbulating with a minimal impact on, or tolerable reduction of, the line pressure of the carbonated water. Of course, the variables of overall line length, line O.D. and I.D., coil wire gauge, pressure requirements of the particular valves or beverage dispenser being used, and so forth, can be adjusted to fit the design requirements of the particular application. Typically, a turbulating means such as a coil 42 will extend along the end 5 to 15% of each water line 34*a* and 34*b*.

We claim:

1. A beverage dispenser, comprising:

a lower housing, the housing having front, rear, right and left vertical side walls extending upward to a top horizontal end wall from a bottom horizontal end surface for defining a cold plate retaining interior area, a cold plate held within the cold plate retaining interior area and the cold plate having front, rear, right and left ends, and the cold plate positioned within the housing interior are along the bottom end surface thereof wherein the cold plate front, rear, right and left ends are positioned adjacent the housing front, rear, right and left vertical end walls respectively, the cold plate having a top surface and having one or more beverage lines extending through an interior thereof below the cold plate top surface, the one or more beverage lines each having an inlet end extending from the cold plate for connection to a source of beverage and each one or more beverage line having an outlet end for connecting to a beverage dispensing valve so that ice retained on the cold plate top surface provides for heat exchange cooling of a beverage as it passes through its respective beverage line through the cold plate from the source thereof to a beverage dispensing valve, and the one or more lines passing through the cold plate in a direction from the front end to the rear end thereof in a serpentine fashion wherein the one or more lines alternate back and forth between the cold plate right and left ends so that a high heat exchange portion of each of the one or more lines lies substantially within and defines a high heat exchange front portion of the cold plate and where the high heat exchange cold plate portion lies substantially directly below an access opening in the housing top horizontal end wall.

2. The dispenser as defined in claim 1, and further including a dispensing tower for supporting the one ore more beverage dispensing valves thereon, the tower secured to a top surface of the housing top horizontal end wall adjacent and along an intersection thereof with the housing rear vertical wall whereby the tower is positioned above a low heat exchange rear portion of the cold plate.

3. The dispenser as defined in claim 1, and the inlet of each one or more beverage line entering the cold plate along the front end thereof.

4. The dispenser as defined in claim 1, and the outlet of each one or more beverage line exiting the cold plate from the rear end thereof.

5. The dispenser as defined in claim 1, and the cold plate having ice bin retaining walls secured thereto around a perimeter of the cold plate top surface and extending upward therefrom for defining an ice retaining bin there above.

6. A beverage dispenser, comprising:

a lower housing, the housing having front, rear, right and left vertical side walls extending upward to a top horizontal end wall from a bottom horizontal end surface for defining a cold plate retaining interior area, a cold plate held within the cold plate retaining interior are and the cold plate having front, rear, right and left ends, and the cold plate positioned within the housing interior are along the bottom end surface thereof wherein the cold plate front, rear, right and left ends are positioned adjacent the housing front, rear, right and left vertical end walls respectively, the cold plate having a top surface and having one or more beverage lines extending through an interior thereof below the cold plate top surface, the one or more beverage lines each having an inlet end extending from the cold plate for connection to a source of beverage and each one or more beverage line having an outlet end for connecting to a beverage dispensing valve so that ice retained on the cold plate top surface provides for heat exchange cooling of a beverage as it passes through its respective beverage line through the cold plate from the source thereof to a beverage dispensing valve, and the one or more lines each having an initial high heat exchange portion defined by an initial heat exchange portion generally located in a front portion of said plate defining a high heat exchange portion of the cold plate so that with the positioning of the cold plate within the housing interior with respect to the vertical side walls thereof the high heat exchange portion of the cold plate lies substantially directly below an access opening in the housing top horizontal end wall.

7. The dispenser as defined in claim 6, and further including a dispensing tower for supporting the one or more beverage dispensing valves thereon, the tower secured to a top surface of the housing top horizontal end wall adjacent and along an intersection thereof with the housing rear vertical wall whereby the tower is positioned above a low heat exchange portion of the cold plate.

8. The dispenser as defined in claim 6, and the inlet of each one or more beverage line entering the cold plate along the front end thereof.

9. The dispenser as defined in claim 6, and the outlet of each one or more beverage line exiting the cold plate from the rear end thereof.

10. The dispenser as defined in claim 6, and the cold plate having ice bin retaining walls secured thereto around a perimeter of the cold plate top surface and extending upward therefrom for defining an ice retaining bin there above.

11. A beverage dispenser, comprising:

a lower housing, the housing having front, rear, right and left vertical side walls extending upward to a top horizontal end wall from a bottom horizontal end surface for defining a cold plate retaining interior area, a cold plate held within the cold plate retaining interior area and the cold plate having front, rear, right and left ends, and the cold plate positioned within the housing interior are along the bottom end surface thereof wherein the cold plate front, rear, right and left ends are positioned adjacent the housing front, rear, right and left vertical end walls respectively, the cold plate having a top surface and having one or more beverage lines extending through an interior thereof below the cold plate top surface, the one or more beverage lines each having an inlet end extending from the cold plate for connection to a source of beverage and each one or more beverage line having an outlet end for connecting to a beverage dispensing valve so that ice retained on the cold plate top surface provides for heat exchange cooling of a beverage as it passes through its respective beverage line through the cold plate from the source thereof to a beverage dispensing valve, and the one or more lines entering the cold plate adjacent the front end thereof and passing through the cold plate in a direction from the front end to the rear end thereof in a serpentine fashion wherein the one or more lines alternate back and forth between the cold plate right and left ends, and the one or more lines each having an initial high heat exchange portion wherein the high heat exchange portion of each of the one or more lines lies substantially within and defines a high heat exchange front portion of the cold plate and wherein the one or more beverage lines have a low heat exchange portion within and defining a low heat exchange portion of the cold plate, and the high heat exchange cold plate portion positioned substantially directly below an access opening in the housing top horizontal end wall for permitting easy physical access to the cold plate top surface lying above the cold plate high heat exchange portion.

12. The dispenser as defined in claim 11, and further including a dispensing tower for supporting the one or more beverage dispensing valves thereon, the tower secured to a top surface of the housing top horizontal end wall adjacent and along an intersection thereof with the housing rear vertical wall whereby the tower is positioned above a low heat exchange portion of the cold plate.

13. The dispenser as defined in claim 11, and the outlet of each one or more beverage line exiting the cold plate from the rear end thereof.

14. The dispenser as defined in claim 11, and the cold plate having ice bin retaining walls secured thereto around a perimeter of the cold plate top surface and extending upward therefrom for defining an ice retaining bin there above.

* * * * *